United States Patent [19]

Hunt

[11] Patent Number: 5,064,136

[45] Date of Patent: Nov. 12, 1991

[54] PAYOUT TUBE FOR CONTAINER PACKAGED COILED FILAMENT

[75] Inventor: Rodney J. Hunt, Omaha, Nebr.

[73] Assignee: AT&T Bell Laboratories, Murray Hill, N.J.

[21] Appl. No.: 572,812

[22] Filed: Aug. 24, 1990

[51] Int. Cl.[5] ..... B65H 57/12; B65H 57/18; B65H 55/00; B65H 49/08

[52] U.S. Cl. ..... 242/157 R; 242/137.1; 242/163; 242/171

[58] Field of Search ..... 242/157 R, 163, 170, 242/171, 132, 137, 137.1, 138, 146

[56] References Cited

U.S. PATENT DOCUMENTS

| | | | |
|---|---|---|---|
| 4,022,399 | 5/1977 | Zajac | 242/163 |
| 4,057,203 | 11/1977 | Newman et al. | 242/163 |
| 4,057,204 | 11/1977 | Zajac | 242/163 |
| 4,160,533 | 7/1979 | Kotzur et al. | 242/137.1 |
| 4,274,607 | 6/1981 | Priest | 242/163 |

*Primary Examiner*—Stanley N. Gilreath
*Attorney, Agent, or Firm*—Ruloff F. Kip

[57] ABSTRACT

The invention is for improvements in a payout tube for a container-packaged coiled wire in which the tube in use is in the container along with the wire coil, a stub of the tube at its exit end protrudes through a hole in a container wall, and the tube is secured to that wall by having sections of the wall around the hole interposed between (a) a flange disposed on the tube on the inside of such wall in contact with such sections, and (b) locking tabs axially spaced on the tube from such flange and disposed on the outside of such wall in contact with such portions. One improvement is that the flange is replaced by lugs providing around the tube pairs of stop portions of which the portions in each pair are separated by notch openings respective to those tabs and each disposed axially opposite its corresponding tab, each such tab having facing towards its corresponding opening, a guide surface comprising a flat land and a camber at one margin of such tab, and each such tab and the stop portions flanking such corresponding notch opening defining an inflected passage for relative movement between such tab and stop portions of a corresponding one of said wall sections. Another improvement is to provide in such tube a restraining means which provides temporary resistance to a change in the movement of the wire through the tube.

13 Claims, 4 Drawing Sheets

PAYOUT TUBE FOR CONTAINER PACKAGED COILED FILAMENT

FIELD OF THE INVENTION

This invention relates generally to devices for dispensing a filamental article (as, say, insulated wire, stranded cable or the like) from a coil of such filament. More particularly, this invention relates to devices of such kind in which the filament is stored in a coil in turn packaged in a box or other container, and in which the dispensing device consists of a payout tube which is mostly disposed in the container but has a stub received in a hole in a wall of the container to provide a passage from its inside to its outside for filament led from the coil through the tube.

BACKGROUND OF THE INVENTION

U.S. Pat. No. 4,057,204 issued Nov. 8, 1977 in the name of R. E. Zajac to Windings, Inc. ("Zajac") discloses a payout tube of the above described sort in which an annular flange encircles the tube near its exit end to provide a planar stop surface extending continuously around the tube and the tube has at such end, outward of the flange, on diametrically opposite sides of the tube, a pair of projections which extend radially out from the tube to lie over the flange and which are shown as being of triangular cross section in planes normal to the radial center lines of the projections. The walls of such projections towards that flange are planar and slope in opposite directions as seen in a direction along the tube diameter between those center-lines.

The Zajac tube is secured in position within the container by (a) providing in a wall of the container a circular hole of the tube's diameter and having equangularly spaced around it a pair of notches formed in the hole's circumference for receiving the tube projections, (b) positioning the tube inside the container to pass a stub portion of such tube through such hole and such projections from inside to outside through such notches until the tube flange bears against such wall around the circumferential margin of the hole, and (c) then turning the tube 90° to cause portions of the wall around the tube to be interposed between such flange and the tube projections to thereby secure the tube to the wall. According to the Zajac patent as it is understood, what happens in the course of such turning is that, because the space between the flanges and the axially inner edges of the sloping projection walls towards the flange is a space less then the wall thickness of the container, the turning of the tube causes the inclined lower surfaces of the projections to ride up on the box material and grip into it to prevent accidental turning of the tube to an improper position. The Zajac patent also indicates in its abstract that improper turning of the tube is avoided because the effect of the tube projections on the box material is that the projections "dig into it".

The Zajac tube has features which may lead to the following disadvantages. First, the digging into the box material by the sharp inner edges of the tube projections may macerate the box material or otherwise weaken it so that it will no longer provide sufficient support to anchor the tube to the box. Second, the sharp leading outer edges of the triangular cross sections of the Zajac projections tend, at the beginning of turning of the tube, to dig into the box material and damage it and prevent further turning of the tube.

SUMMARY OF THE INVENTION

These and other disadvantages are avoided according to the invention by a payout tube comprising:

a tubular sleeve having an axis and having entrance and exit ends for a filament led therethrough, a pair of stop portions angularly adjacent each other around said tube and spaced from each other by an opening and radially projecting at such exit end away from such sleeve and having thereon respective stop surfaces on one axial side of such portions, such stop surfaces defining a plane normal to such axis, a locking tab disposed around such sleeve at an angular position intermediate those of such stop portions and having thereon a guide surface spaced by respective gaps from one and the other of said stop surfaces, and said stop surfaces and guide surface defining a passage for movement (produced by turning of the tube) of box material (bordering the mentioned hole) into one said gaps and by such tab and out of the other gap to thereby be interposed between such stop portions and such tab so as to retain the tube in turned position, such passage having in the extent of such movement an inflection of concave configuration in the axial direction towards the exit end of the tube, and the minimum width of such passage being greater than the minimum spacing in the axial direction of such tab from such plane. A payout tube of such character may be firmly retained in its 90° turned position without the necessity for any part of the tube to grip into the box material as does the Zajac tube. Moreover, such tube permits one or more other benefits to be realized.

BRIEF DESCRIPTION OF THE DRAWING

For a better understanding of the invention, reference is made to the following description of an exemplary embodiment thereof, and to the accompanying drawings wherein.

In the description which follows, the term "angular" refers in a system of polar coordinates to the angular direction around the payout tube.

DETAILED DESCRIPTION

Figure 1:
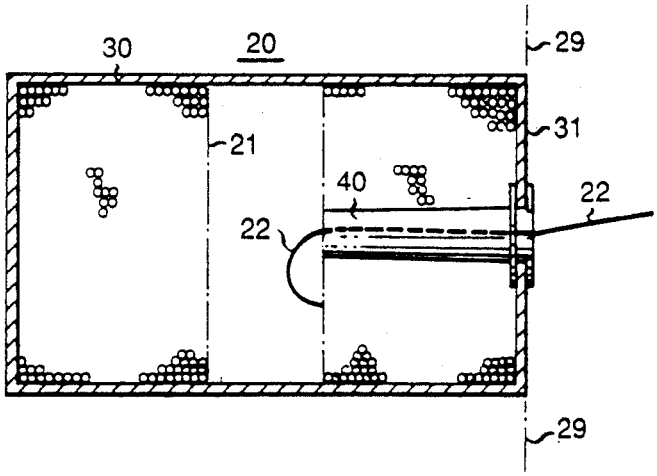
FIG. 1 is a schematic front elevational view, partly in cross-section, of the assemblage of a coil of filamental material, a container in which such coil is packaged, and payout tube disposed in the container for dispensing from the container the filament payed out from the coil.

Referring now to FIG. 1, the reference number 20 designates an assembly of a coil 21 of a filamental material packaged in a container 30 in which is a payout tube 40 for dispensing lengths of such material from the container. A filament 22 of such material is shown as extending from coil 21 through tube 40 to the outside of container 30. The filament 22 depicted is an insulated electrical wire, but the invention is not limited for use only with such wire.

The coil 21 may comprise superposed layers of filament in figure "8" configurations in which the crossovers of the configurations in successive layers migrate around a central core for the coil. Coils of such kind are disclosed in U.S. Pat. Nos. 4,057,204 and 4,274,607.

The container 30 is in the form of a box having a square bottom and top joined by vertical rectangular side walls including a wall 31 on the right side of the box. The undeformed outer surface of wall 31 defines a plane 29. The bottom, top and side walls of box 40 are constituted of corrugated or uncorrugated cardboard or fiberboard or other packaging material adapted when constituting a portion of a wall or other panel to be resiliently flexible over a useful range of deformation.

Wall 31 has formed therein (FIG. 6) a hole 32 comprising a circular main aperture 33 and a pair of notches 34, 35 diametrically opposite each other around aperture 33 and extending radially outward from the circumference of that aperture.

The payout tube 40 comprises (FIGS. 2–5) a molded synthetic resinous tubular sleeve 41 having an axis 39 and entrance and exit ends 42, 43 for the filament 22. Disposed at exit end 42, somewhat inward of the sleeve's exit opening 44 are two stop lugs 45, 46 integral with and disposed on diametrically opposite sides of sleeve 41 to be at opposite ends of a diameter 38 for the sleeve. The lugs 45 and 46 are, as shown, in the form of similar annular segments each having an angular extent around the sleeve of more than a quadrant but less than a semicircle. In consequence of having such disposition and form, lugs 45 and 46 are separated on transversely opposite sides of diameter 38 by the openings 47 and 48 which radially extend away from the periphery of sleeve 41 and which are notch openings in the sense that they are open to the environment of the tube at their radially outward ends. Openings 47 and 48 each provides for unblocked passage therethrough in the axial direction.

Figure 4:
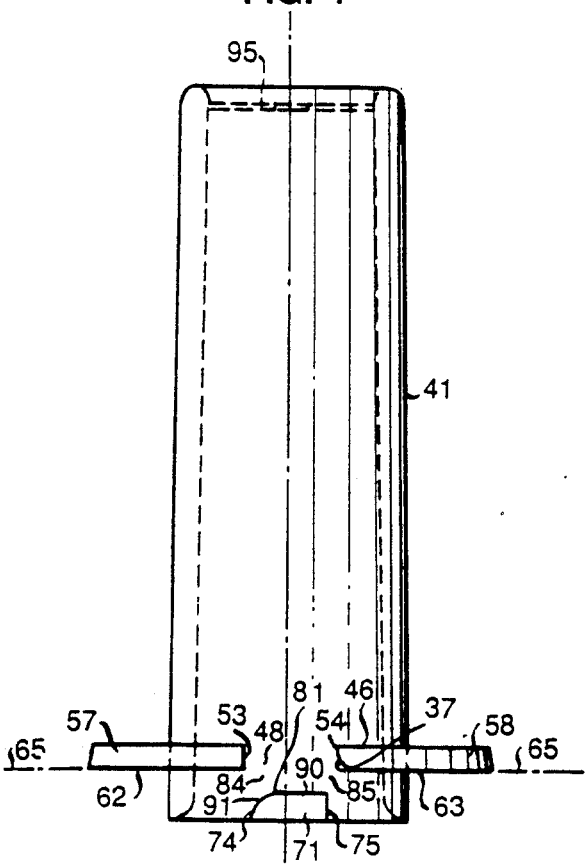
FIG. 4 is a right side elevation view of the FIG. 2 tube.
Figure 5:
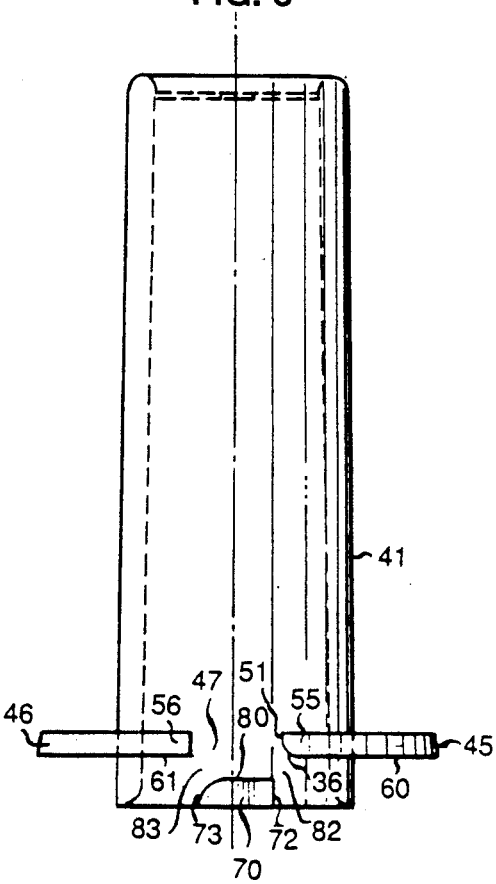
FIG. 5 is a left side elevation, partly broken away of the FIG. 2 tube.
Figure 2:
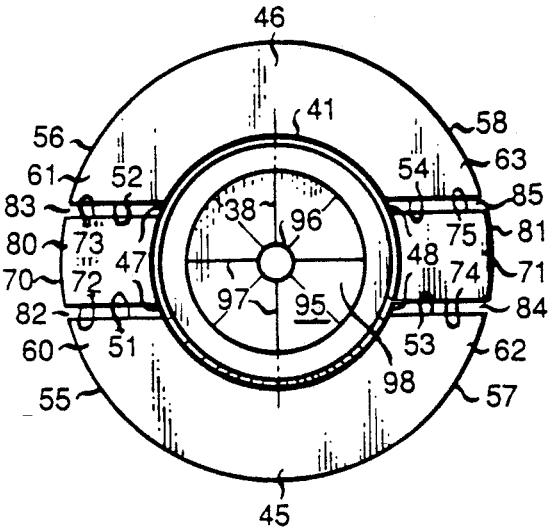
FIG. 2 is a plan view of the FIG. 1 payout tube when in upright position.
Figure 3:
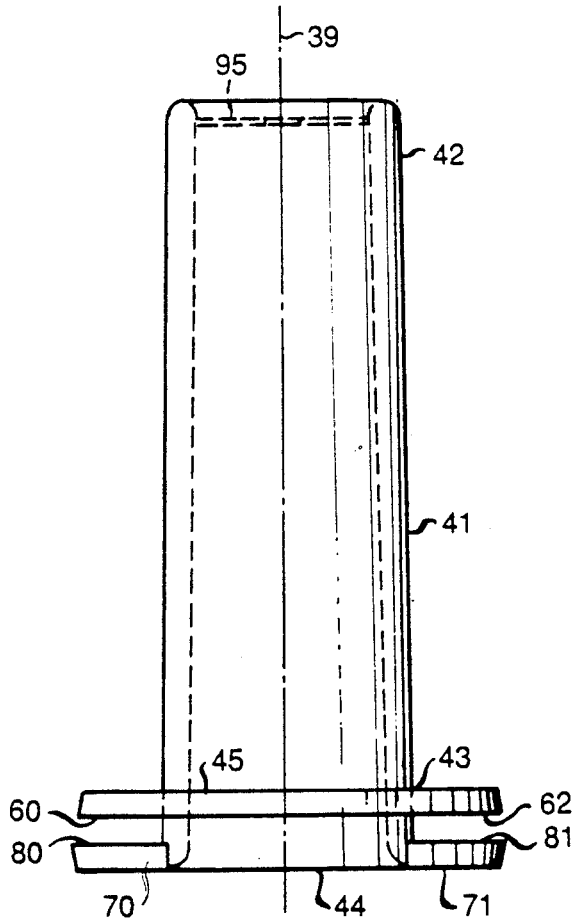
FIG. 3 is a front elevation view of the FIG. 2 tube.
Figure 8:
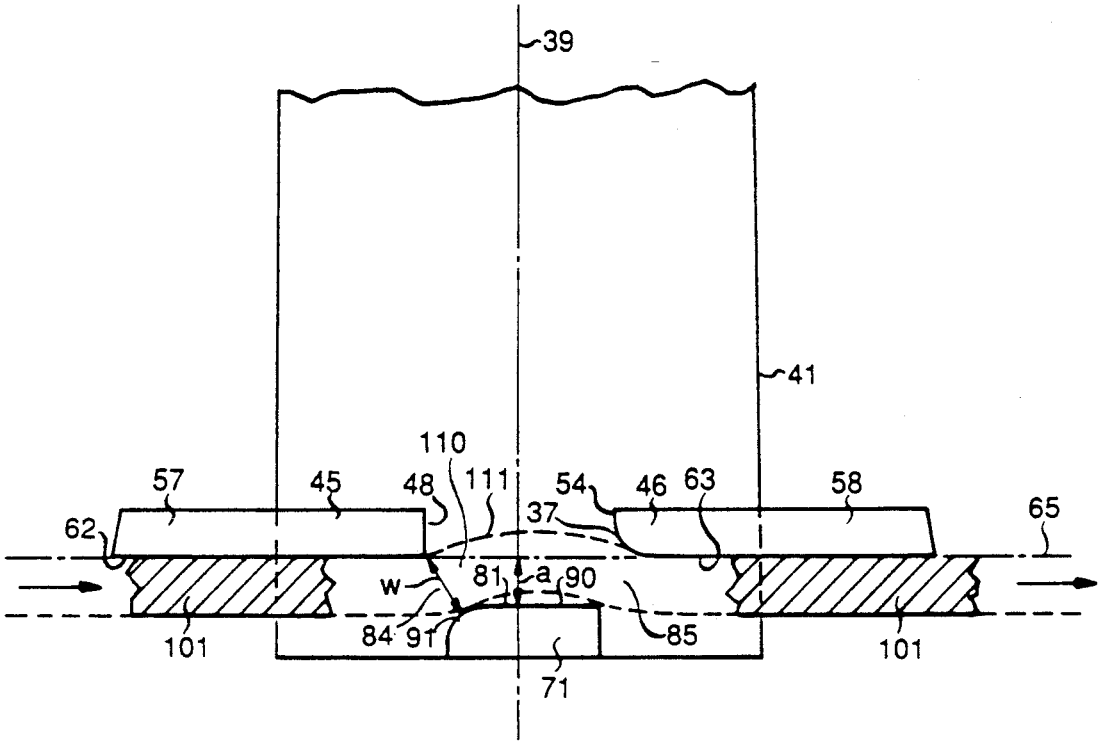
FIG. 8 is an enlarged plan view of the inserted and turned tube of FIG. 7 and of portions of the container wall (depicted in cross-section) shown in FIGS. 6 and 7.

Considering further details of elements 45–48, the stop lugs project radially outward from the periphery of sleeve 41 in both directions of a first dimension colinear with diameter 38 and, also, in both directions of a second dimension normal to such diameter. The notch openings 47 and 48 between the lugs are bounded on angularly opposite sides of such openings by lug margins 51, 52, 53, 54 which are normal to such diameter, i.e., are aligned with said second dimension and parallel with each other. Thus openings 47 and 48 are of constant width normal to their radial centerlines. As shown in FIGS. 4, 5 and 8, the lug margins 51 and 54 have faired surfaces or cambers 36 and 37 on their undersides.

The lugs 45 and 46 provide on opposite sides of opening 47 a first pair of angularly adjacent stop portions 55 and 56 respective to these lugs. Similarly lugs 45 and 46 provide on opposite sides of opening 48 a second pair of stop portions 57 and 58 respective to the lugs 45 and 46. The stop portions 55–58 of the tube 40 are so called because they are adapted in the use of tube 40 to bear against the inner side of box wall 31 to stop the tube from further movement outward through hole aperture 33.

The stop portions 55–58 have thereon respective surfaces 60–63 which are disposed on the axial side of such portions towards the exit opening 44 of sleeve 41, and which surfaces (or parts thereof) lie in and define a plane 65 (FIG. 4) normal to the axis 39 of the sleeve.

Those surfaces (or parts thereof) are adapted to bear against the inner side of wall 31 to stop tube 40 as described above. For convenience, such surfaces are referred to herein as "stop surfaces" although it does not necessarily means that all areas of such surfaces lie in plane 65 or perform the stopping function just mentioned.

Besides the radial projections provided on sleeve 41 by lugs 45 and 46, the sleeve has thereon two additional projections in the form of locking tabs 70 and 71 disposed to be at angular positions corresponding to those of openings 47 and 48 and intermediate those of, respectively, the stop portions 55, 56 and the stop portions 57, 58. The tabs 70 and 71 are coupled and integral with sleeve 41 and project away from it in radially opposite directions. Tab 70 has angularly opposite margins 72, 73 adjacent and parallel to the margins 51, 52 on the lugs 45 and 46 while tab 71 has angularly opposite margins 74, 75 adjacent and parallel to the margins 53, 54 on those lugs.

In the axial direction, the tabs 70 and 71 are disposed on sleeve 41 outward of the lugs 45 and 46 to be axially opposite the interlug openings 47, 48, but the tabs are not further out than the sleeve's exit opening 44. The tabs have thereon respective guide surfaces 80 and 81 facing in the axial direction towards the entrance end of the sleeve and axially displaced from the plane 65. The guide surface 80 of tab 70 is separated by gaps 82 and 83 from, respectively, the stop surface 60 on lug 45 and the stop surface 61 on lug 46. Similarly the guide surface 81 on tab 71 is separated by gaps 84 and 85 from, respectively, the stop surface 62 on lug 45 and the stop surface 63 on lug 46.

The guide surface 81 on tab 71 (FIG. 4) consists for the most part of a flat land 90 lying parallel to plane 65. That surface also includes, however, at the left hand margin 74 of tab 71 a rounded surface area 91 providing at that margin a camber for tab 71. The guide surface 80 of tab 70 is similarly shaped (FIG. 5) to consist for the most part of a flat land parallel to plane 65 but to include also at its margin 73 a rounded surface area providing at such margin a camber for tab 70.

The interior of sleeve 41 contains at the sleeves entrance end 42 a diaphragm 95 (FIG. 2) integral with the sleeve and extending across such interior. The diaphragm is perforated at its center by an axial aperture 96 of slightly smaller diameter than filament 22 and at the center of a "star" configuration formed of a plurality of slits 97 equangularly distributed around hole 96 and radially extending outward from it. The slits 97 divide the area of diaphragm 95 adjacent aperture 96 into resiliently deflectable fingers 98 which, as later explained in more detail, are operable to impose on filament 22 a limited force opposing reversal in the motion of the filament.

USE OF THE EMBODIMENT

Figure 6:
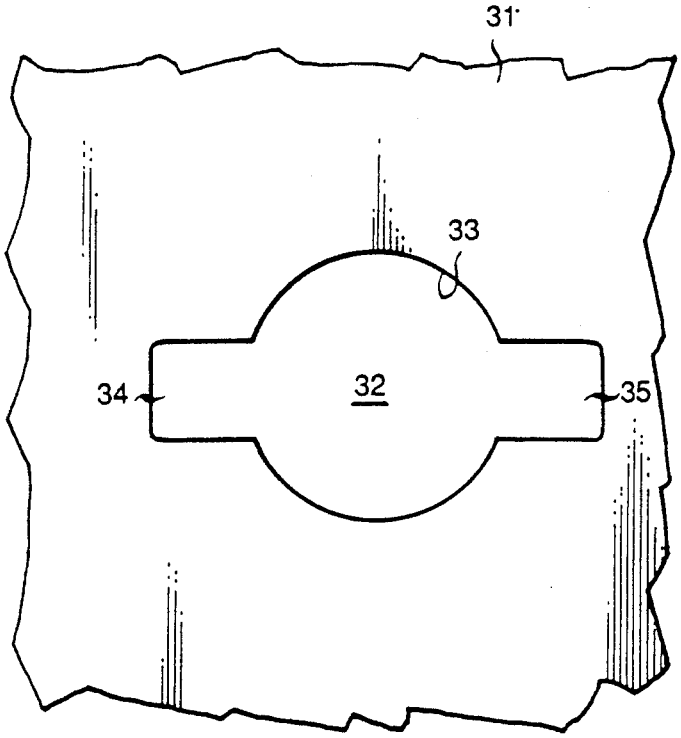
FIG. 6 is a fragmentary right side elevation view of the FIG. 1 container showing an outlet hole made in a wall of such container for the payout tube shown in FIGS. 1–5.
Figure 7:
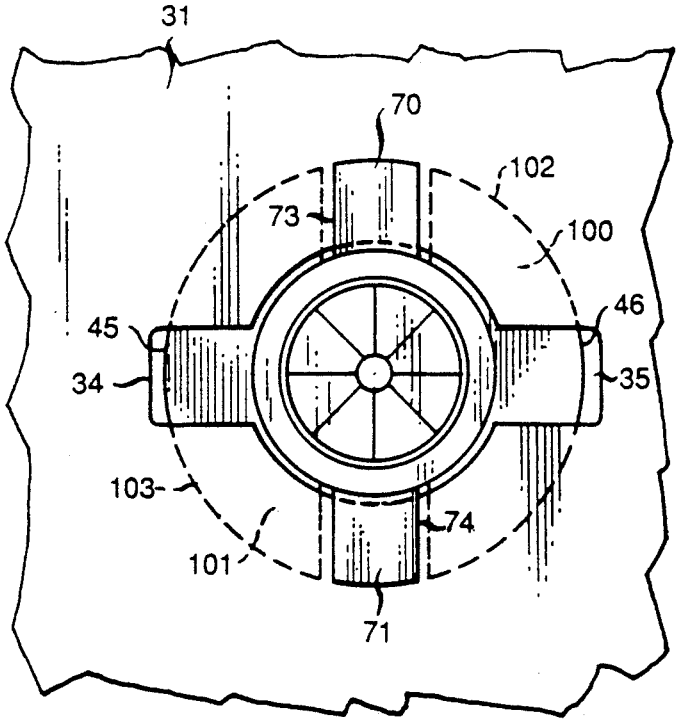
FIG. 7 is a view of the mentioned hole similar to that of FIG. 6 but showing in addition the mentioned tube of FIGS. 1–5 after it has been inserted into and then turned 90° in the FIG. 6 hole.

The manner in which payout tube 41 is secured to container 30 is shown by FIGS. 6–8 and is as follows.

With the tube being in the container, the tube is axially aligned with aperture 33 in the container's wall 31 and is then rotated about its axis to bring the tube tab 71 into angular alignment with the notch 34 of the hole 32 through container wall 31, the camber 91 on the tab being on its downside when the tab is so angularly aligned. The tube is then advanced towards container wall 31 to pass such tab through such notch and to pass tab 70 through notch 35. The advance in that direction of the tube is stopped by the coming into contact of the stop surfaces 60–63 on the tube's stop lugs 45, 46 with the inside surface of the box wall 31. As best shown in FIG. 6, the notches 34 and 35 through which the tabs 71 and 70 are passed may have radial lengths greater by more than a clearance than the radial lengths of such tabs.

Having thus passed the locking tabs 70 and 71 of tube 40 to the outside of box wall 31 and produced engagement between the stop surfaces of that tube and the inside of such wall, the tube is next turned counterclockwise (FIG. 6) about its axis through an angular arc which ultimately reaches 90° . The results of such turning is depicted in FIGS. 7 and 8. At the beginning of the turning, the cambers on the tabs 70 and 71 engage the adjacent margins of the notches 35 and 34 to deflect inwards (i.e., towards the center of box 30) two sections 100 and 101 of box wall 31 which border hole 32, and the areas occupied by which are indicated very approximately in FIG. 7 by the dash lines 102 and 103. These wall sections can be conveniently regarded for analysis purposes as constituting resiliently bendable beams which have base ends at the outer ends of notches 34, 35, terminate in free ends at the circumference of aperture 33, and are held to the expanse of wall 31 at their base ends and at their sides away from notches 34, 35. Increasing the radial lengths of such notches will, of course, increase the lengths of such beams and thereby decrease their stiffness to resist deflection.

After such deflection of sections 101 and 102 commences, what happens thereafter is shown in FIG. 8 for tab 71 and the wall section 101 with which that tab interacts. To wit, the tab 71 and the stop portions 57, 58 of the lugs 45 and 46 define a passage 110 which is indicated in FIG. 7 by dash lines and which angularly extends into the gap 84 between tab 71 and lug 45, then by that tab and then out of the gap 85 between tab 71 and the lug 46. The passage 110 is for relative movement therethrough of the otherwise stationary wall section 101. The passage is bound over part of the extent of such movement, on transversely opposite sides of the line of such movement by, respectively, the stop surfaces 62, 63 on the lugs 45, 46 and the guide surface 81 on tab 71. In however, the span of the passage 110 across the opening 48 between lugs 45 and 46, it is bound on only one such side by the guide surface 81 on the tab. As shown in FIG. 8, the passage 110 has, in the extend of such movement, an inflection 111 which is concave as viewed in the axial direction towards the entrance end 42 of sleeve 41, and which inflection is next to guide surface 81 and spans opening 48.

As tube 40 is first turned counterclockwise after tab 71 has, as described, been displaced through wall notch 34 to the outside of wall 31, the camber 91 on the tab diverts into the gap 84 of passage 110 the leading edge of wall section 101 which (if of a certain thickness) is resiliently bent in the course of such diversion to follow the curvature of the inflection 111 in the passage. Such bending places the wall section under resilient stress which, as such leading edge passes the right hand margin 75 of tab 71, tends to deflect the part of wall section 101 at such edge back to its original unstrained position to promote the emergence of such edge out from behind tab 71 through the gap 85 of passage 110.

Also, such leading edge of wall section is, upon contacting the rounded surface of camber 37 on the underside of margin 54 of lug 46, deflected and diverted by that camber in the axial direction towards the exit of tube 41 to promote emergence of such leading edge out of gap 85. Once that edge has so emerged, the turning of tube 40 and the consequent relative movement of wall section 101 through passage 110 is continued until the tab 71 has been angularly turned through 90° to reach its position shown in FIG. 7. When the tab is at that position, the interposition between that tab and stop lugs 45, 46 of a portion of box wall substantially displaced from both of notches 34 and 35 inhibits movement of the tube 40 relative to box wall 31 in either axial direction. Further, reverse turning of the tab to return to notch 34 and thus be positioned to regress through it is impeded by the existence between the tab 71 and wall section 101 of friction which is enhanced by the fact that such section in moving through passage 110 has been resiliently stressed to exert axial force on the tab as a result of such stress. The tab 71, therefore, serves to lock the tube 40 in secured relation to container wall 31.

The cooperation of tab 71 and stop portions 57 and 58 on the lugs 45 and 46 is capable alone of securing tube 40 to container 30. The use, however, of tabs 71 and 70 together makes such securing more reliable. Tab 70 and stop portions 55, 56 define for wall section 100 a passage similar to the passage 110 just described, and that tab and stop portions interact with section 100 in the same way as elements 71, 57, 58 do with wall section 101 to contribute to locking tube 40 to container 30.

The passage 110 has a width w which is transverse to the centerline of that passage, and of which the minimum size or value is greater than the minimum value of the axial displacement a of the guide surface 81 on tab 71 from the plane 65 defined by the (or parts of the) stop surfaces on stop portions 57 and 58. That minimum size of such width of the passage 110 occurs within one or both of the gaps 84 and 85 of the passage. Within a central region of notch opening 48 between the stop lugs 45 and 46, such transverse width of the passage 110 is not definitely fixed.

The minimum value of the width w of passage 110 should preferably be not less than the value of the thickness t of the box wall 31 in order not to make it unduly difficult for the wall section 101 to be advanced through the passage. On the other hand, such thickness t may be made less than the minimum size for width w down to a value for t exactly or about the value of the axial displacement a of tab 71 from plane 65. When such thickness t is at or less than that value a, the wall section 101 may be relatively advanced through passage 110 without any significant bending of that section.

Before or after the payout tube 40 is secured, as described to the wall 31 of the container, the free end of filament 22 is positioned at the tube's entrance end 42, next moved forward through central aperture 96 of diaphragm 95, and then moved through the length of the tube to emerge from its exit opening 44 and extend for a distance beyond it. Diaphragm 95 is adapted to act as a filament restraining means as follows. The greater diameter of filament 22 than that of aperture 96 causes the diaphragm fingers 98 to be resiliently deflected radially outwards and, concurrently, the drag of the moving filament on the fingers causes them to be deflected axially forward. Such fingers remain so deflected while such filament's forward movement continues and when it stops. If the filament thereafter experiences an active force acting to the left of diaphragm 95 (FIG. 1) to tend to pull the filament rearward through the diaphragm, the frictional contact of fingers 98 with the filament and the described deflection of such fingers will cooperate to impart to the filament a counterforce which (a) opposes such active force to restrain rearward filament movement so long as the active force does not exceed an upper limit value, but which (b) will yield, of such force does exceed such value, to permit such rearward motion. It will be evident from what has been said that diaphragm 95 is capable of acting bidirectionally to provide such limited restraining effect.

Figure 9:
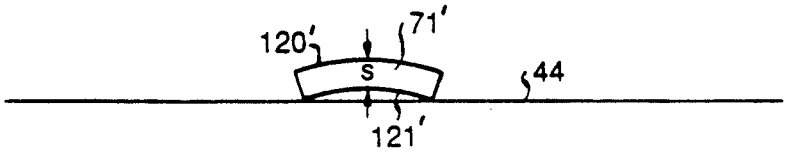
FIG. 9 is a detail view of a modification in the configuration of the locking tabs of the tube of FIGS. 1–5.

FIG. 9 shows a locking tab 71' which is a modified version of tab 71, and which has a configuration adapted to be used for both of the locking tabs in place of the configuration shown for tabs 71 and 70 in FIGS. 4 and 5. To consider that alternative configuration, the cross-section of tab 71' (normal to its radial centerline) is in the form of an angular segment of an annulus. As a result, the tab 71', on its sides towards the entrance and exit ends of tube 40, has, respectively, the surfaces 120' and 121' of which both are circular cylindrical surfaces, and which are separated from each other by a constant radial distance s constituting the thickness of the tab in the radial direction. With tab 71' having such configuration, it is well adapted to contribute to guiding the wall section 101 through passage 110 as earlier described while, concurrently, the tab has good strength by virtue of being of its full thickness throughout its angular extent.

The above described embodiment being exemplary only, additions thereto, omissions therefrom, and modifications thereof may be made without departing from the spirit of the invention.

Accordingly, the invention is not to be considered as limited save as is consonant with the recitals of the following claims.

I claim:

1. A payout tube for a filament disposed in a coil in a container having an outlet hole for such tube in a container wall, said tube comprising:

a tubular sleeve having an axis and having entrance and exit ends for said filament, a pair of stop portions angularly displaced from each other around said sleeve and projecting at such exit end radially away from the periphery of said sleeve and having thereon respective stop surfaces on one axial side thereof, a locking tab projecting radially away from such periphery and disposed around said sleeve at an angular position intermediate those of said stop portions, said tab having a guide surface spaced by respective gaps from said stop surfaces, and said stop portions and tab defining a passage for relative movement therethrough of a section of said wall adjacent said hole into one of said gaps and by said tab and out of the other of said gaps, said passage in the extent of such movement being at least partly bounded on opposite sides by, respectively, said stop surfaces and said guide surface, at least a portion of said guide surface of said tab being a rounded surface area providing a camber for said tab.

2. A payout tube according to claim 1 in which at least a portion of said guide surface of said tab consists of a flat land area.

3. A payout tube according to claim 1 further comprising:

a pair of stop portions in addition to and similar to said first-named pair thereof, and a locking tab in addition to and similar to said first-named tab, said additional stop portions and tab being half way around and diametrically across said sleeve from said first-named stop portions and tab and being, moreover, cooperable with each other to define a passage similar to the aforesaid passage defined by said first-named stop portions and tab.

4. A payout tube according to claim 1 in which said stop portions have therebetween a radially extending opening and in which said tab is disposed around said sleeve to be at the angular position of said opening.

5. A payout tube according to claim 4 in which said stop portions have respective radially extending margins bounding angularly opposite sides of said opening therebetween, and in which said tab has angularly opposite radially-extending margins adjacent to one and the other, respectively, of said stop portion margins.

6. A payout tube according to claim 5 in which a first of said tab margins is rounded to provide on said tab at such first margin a convex camber facing towards the one of said stop portions adjacent said first margin, and in which such radially extending margin of the other of said stop portions is rounded to provide at such latter margin a convex camber facing toward the second of said margins of said tab.

7. A payout tube according to claim 4 in which said tab is non-overlapping with said stop portions in the angular direction around said sleeve.

8. A payout tube for a filament disposed in a coil in a container having an outlet hole for such tube in a wall of such container, said tube comprising:

a tubular sleeve having an axis and having entrance and exit ends for said filament, a pair of stop lugs disposed at said exit end on opposite sides of said sleeve to be at opposite ends of a diameter of said sleeve, said lugs having respective stop surfaces having respective areas in a plane normal to said axis, and said lugs projecting away from said sleeve in opposite directions in a first dimension colinear with said diameter, and in opposite directions in a second dimension normal to said diameter so as to have between them two openings disposed on transversely opposite sides of said diameter and radially extending away from said sleeve and each open to the environment of the tube at its radially outward end, and a pair of locking tabs radially projecting away from said sleeve, and angularly disposed around said sleeve to be at the angular positions of, respectively, one and the other of said openings.

9. A payout tube according to claim 8 in which the angularly opposite margins of each of said first and second tabs are inwardly offset in the angular direction from the margins respectively adjacent thereto of, respectively, said first and said second pairs of stop portions.

10. A payout tube for a filament disposed in a coil in a container having an outlet hole for such tube in a wall of said container, said tube comprising:

a tubular sleeve having an axis and having entrance and exit ends for said filament, first and second pairs of stop portions each projecting at such exit end away from said sleeve, said two pairs of stop portions being on angularly opposite sides of said tube, and the two stop portions in each pair thereof being angularly spaced around said sleeve to have between them a notch opening extending away from said sleeve and open to the environment of the tube at the radially outward end of such opening, and first and second locking tabs disposed around said sleeve at the angular positions of, respectively, such notch opening between said first stop portions and such notch opening between said second stop portions, said tabs being coupled to said sleeve and being adapted in cooperation with said stop portions to fasten said tube to said container by receiving between each such pair of stop portions and the associated tab a section bordering said hole of said container wall.

11. A payout tube for a filament disposed in a coil in a container having an outlet hole for such tube in a wall of said container, said tube comprising:

a tubular sleeve having an axis and having entrance and exit ends for said filament, stop means radially projecting at the exit end of said sleeve away from the periphery of said sleeve, said stop means being adapted by bearing against the inner side of said wall to stop outward movement of said sleeve through said hole, and a locking tab radially projecting at said exit end away from the periphery of said sleeve and spaced at such end away from said stop means to provide between said tab and stop means a passage for relative movement therethrough of a section bordering said hole of said wall of said container, said tab having on its side towards said stop means a guide surface of which separate portions comprise, respectively, a flat land area normal to said axis and at least one rounded surface area disposed adjacent said flat land area of said tab and providing a camber therefor.

12. A payout tube according to claim 11 in which said tube comprises an additional locking tab disposed on the diametrically opposite side of said tube from said first named tab and similar to said first-named tab.

13. A payout tube according to claim 11 in which said tube further comprises filament restraining means disposed in the interior of said sleeve adjacent the entrance end thereof, said restraining means comprising a plurality of resiliently deflectable fingers angularly spaced around the interior wall of said sleeve and projecting from said wall radially towards respective terminations thereof angularly distributed around a central opening for axial movement therethrough of said filament, said fingers being adapted by contact with said filament during forward movement of such filament through said opening to be deflected towards said exit end, and to remain as so deflected in contact with said filament so as to yieldably oppose subsequent rearward movement thereof in said sleeve.

* * * * *